US010569573B2

(12) United States Patent
Barrett

(10) Patent No.: US 10,569,573 B2
(45) Date of Patent: Feb. 25, 2020

(54) MOVING GANTRY FLATBED TABLE INKJET PRINTER

(71) Applicant: AGFA NV, Mortsel (BE)

(72) Inventor: Mark Barrett, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/766,876

(22) PCT Filed: Oct. 10, 2016

(86) PCT No.: PCT/EP2016/074140
§ 371 (c)(1),
(2) Date: Apr. 9, 2018

(87) PCT Pub. No.: WO2017/063975
PCT Pub. Date: Apr. 20, 2017

(65) Prior Publication Data

US 2019/0061384 A1 Feb. 28, 2019

(30) Foreign Application Priority Data

Oct. 12, 2015 (EP) ..... 15189372

(51) Int. Cl.

| | |
|---|---|
| ***B41J 2/01*** | (2006.01) |
| ***B41J 11/58*** | (2006.01) |
| ***B41J 3/28*** | (2006.01) |
| ***B41J 3/407*** | (2006.01) |
| ***B41J 11/00*** | (2006.01) |

(52) U.S. Cl.
CPC ..... *B41J 11/58* (2013.01); *B41J 3/28* (2013.01); *B41J 3/407* (2013.01); *B41J 11/002* (2013.01)

(58) Field of Classification Search
USPC ..... 347/2, 4, 16; 83/24; 355/53
See application file for complete search history.

(56) References Cited

U.S. PATENT DOCUMENTS 6,755,518 B2 * 6/2004 Codos ..... B41J 3/28 345/101
7,280,183 B2 * 10/2007 Fukui ..... G03F 7/7005 355/53
2014/0053698 A1 * 2/2014 Hoover ..... B65H 3/0833 83/24

FOREIGN PATENT DOCUMENTS

KR 10-0807086 B1 3/2008
KR 10-2013-0057042 A 5/2013

OTHER PUBLICATIONS

Official Communication issued in International Patent Application No. PCT/EP2016/074140, dated Mar. 15, 2017.

* cited by examiner

*Primary Examiner* — Lam S Nguyen
(74) *Attorney, Agent, or Firm* — Keating and Bennett, LLP

(57) ABSTRACT

An inkjet printing device includes a fast-scan drive module, attached to a first gantry, for moving back-and-forth, parallel to a first direction above a flatbed table, a print head including a nozzle row, wherein the first direction is perpendicular to the nozzle row; and a slow-scan drive module, attached to the inkjet printing device, for moving back-and-forth above the flatbed table, parallel to a second direction, the first gantry on a set of motion rails, attached to the inkjet printing device, wherein the second direction is perpendicular to the first direction; and a first drive module, attached to a second gantry, for moving parallel to the second direction the second gantry on the set of motion rails while an ink-receiver is coupled to the second gantry; and loading the ink-receiver on the flatbed table by decoupling the ink-receiver from the second gantry.

15 Claims, 4 Drawing Sheets

MOVING GANTRY FLATBED TABLE INKJET PRINTER

CROSS REFERENCE TO RELATED APPLICATIONS

This application is a 371 National Stage Application of PCT/EP2016/074140, filed Oct. 10, 2016. This application claims the benefit of European Application No. 15189372.4, filed Oct. 12, 2015, which is incorporated by reference herein in its entirety.

BACKGROUND OF THE INVENTION

1. Field of the Invention

The present invention relates to a moving gantry flatbed table inkjet printer and especially the loading of ink-receivers on the flatbed table and the unloading of print-finished ink-receivers from the flatbed table.

2. Description of the Related Art

The availability of better performing print heads, such as less drop-outs and failing nozzles, and the lower cost of print heads, the maximum printing size of inkjet printing system is enlarged to print on large or multiple ink-receivers such as wood or printing plates. To support these large or multiple ink-receivers, a large flatbed table has to be manufactured. A maximum use of the large flatbed table results in a higher amount of print jobs and better productivity which is economically beneficial.

The most common flatbed table inkjet printing devices are inkjet printing devices wherein an ink-receiver is moving on a conveyor belt, wrapped around a flatbed table, and wherein the ink-receiver is passing a set of print heads, attached to a gantry. The set of print heads scans back-and-forth above the substrate while printing. An example of such Inkjet printing device is the Agfa Graphics™: Jeti Tauro.

Several inkjet printing device manufacturers are also selling moving gantry flatbed table inkjet printers wherein an ink-receiver is loaded on a flatbed table and a gantry, comprising a set of print heads, is moved above the loaded ink-receiver. The set of print heads scans back-and-forth above the ink-receiver while printing. Examples of such moving gantry flatbed table inkjet printers are FUJIFILM™ Acuity Advance Select X2, Agfa Graphics™: Jeti Mira and SwissQPrint™ Nyala 2.

Another method used in flatbed table inkjet printing devices is moving the flatbed table with the loaded ink-receiver underneath a set of print-heads, comprised on a gantry. The set of print heads scans back-and-forth while printing such as Agfa Graphics™: Jeti 3020 Titan.

The several existing methods of flatbed table inkjet printing devices have all their own advantages such as accuracy, high volume production, versatility.

In the state-of-the-art the inkjet printing device manufacturers of moving gantry flatbed table inkjet printers are providing tools to enhance the volume production such as multiple vacuum zones in the flatbed table combined with tandem printing.

The flatbed table is loaded with an ink-receiver from the front of the flatbed table and the print job is started. Whilst the machine processes the first job, the operator starts to load the rear half of the table with another ink-receiver. The gantry moves to the rear and continues the printing process as soon as the front job is finished and the operator confirms that the rear job is ready to start. The operator meanwhile removes the print-finished ink-receiver from the front area and prepares the next ink-receiver for printing.

Inkjet printing device manufacturers are also providing automatic board options to facilitate loading rigid media on the flatbed table such as the board option of SwissQPrint™ for Nyala 2 wherein a feed system of the board option, attached to the gantry, loads an ink-receiver on the flatbed table while the gantry has reached the end of the table.

The state-of-the-art methods such as the board option of SwissQPrint™ for Nyala 2; which is only for rigid media, may have deforming issues on the gantry while feeding heavy loaded ink-receivers which nullify the calibration and adjustments of the print heads on the gantry. Also the feeding of ink-receivers depends on the position of the gantry which is not optimal for a higher volume production on moving gantry flatbed table inkjet printers. The total area of the flatbed table is not fully used by these board options for moving gantry flatbed table inkjet printers and the state-of-the art board-options for such inkjet printing devices is dedicated for rigid medias.

SUMMARY OF THE INVENTION

In order to overcome the problems described above, preferred embodiments of the present invention have been realised with an inkjet printing device as defined below and the method as defined below.

Further advantages and preferred embodiments of the present invention will become apparent from the following description.

DETAILED DESCRIPTION OF THE PREFERRED EMBODIMENTS

Figure 6:
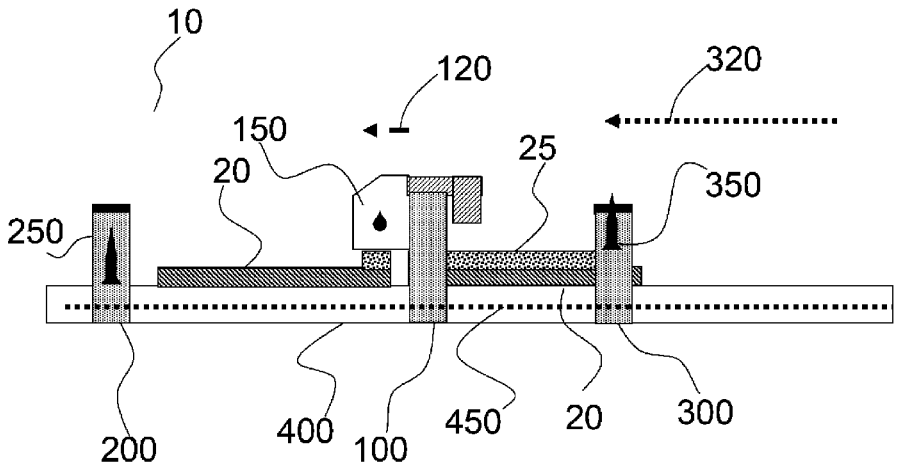
Figure 7:
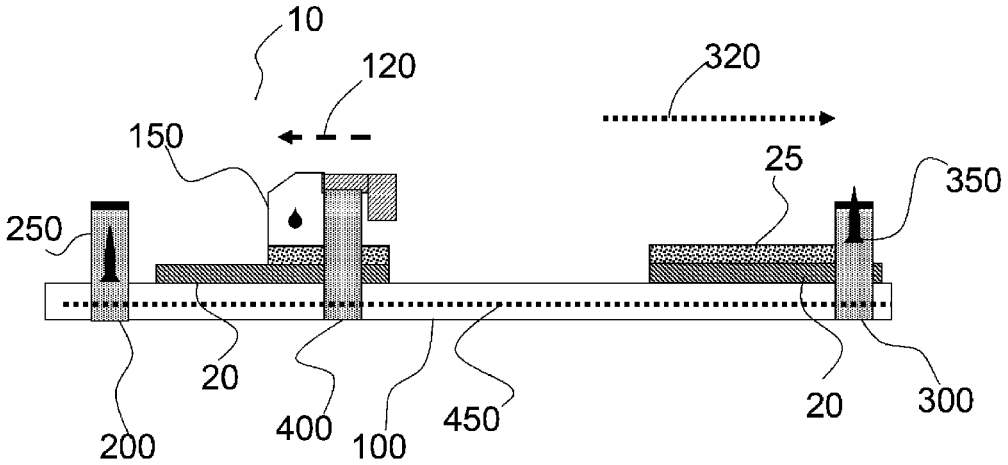

The printing of a jetted layer (25) is done by back-and-forth scanning of a print head (150) on a gantry (100), also called a print gantry, which moves by gantry movements (120) on a motion rail (450). The ink-receivers (20) are loaded by coupling them on another gantry (200) with an ink-receiver (20) coupler (250) and some gantry movements (220) on the same motion rail (450). The other gantry (200) is also called an input gantry. In FIG. 6 and FIG. 7 illustrate the sequences wherein a print-finished ink-receiver is unloaded by a third gantry (300) (300) by coupling it to an ink-receiver coupler (350) and some gantry movements (320) on the same motion rail (450). The inkjet printing device (10) is not illustrated from FIG. 1 until FIG. 7. The back-and-forth scanning of the print head (150) is also not illustrated from FIG. 1 until FIG. 7. The ink-receivers (20) are loaded from a tray and unloaded to another tray. But the trays are not illustrated from FIG. 1 until FIG. 7.

Figure 1:
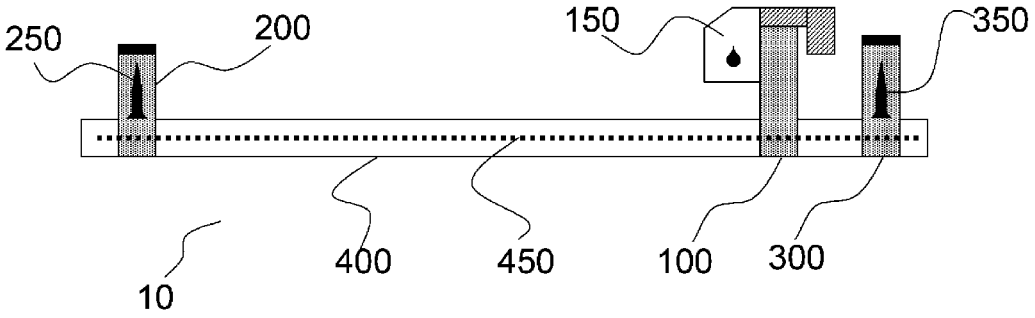
FIG. 1 to FIG. 7 illustrate a preferred embodiment of the present inkjet printing method by an inkjet printing device (10) as a cross section with sequence of steps (FIG. 1 until FIG. 7) to print ink-receivers (20) loaded on the flatbed table (400).
Figure 2:
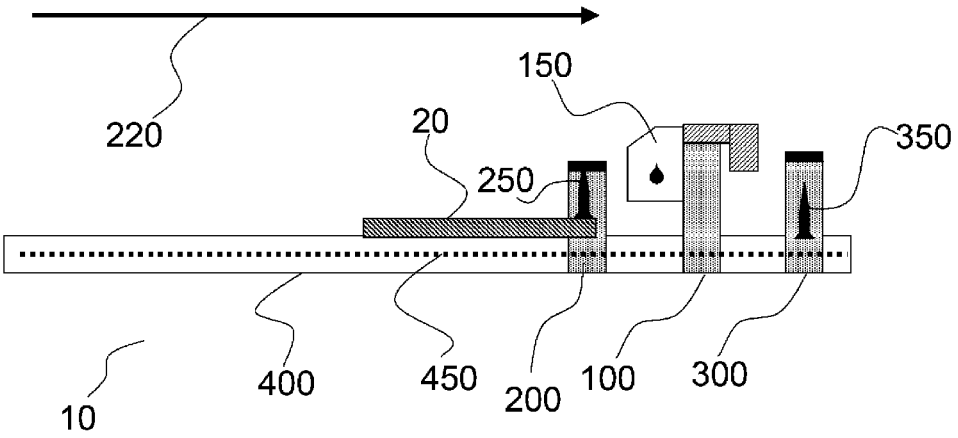
Figure 3:
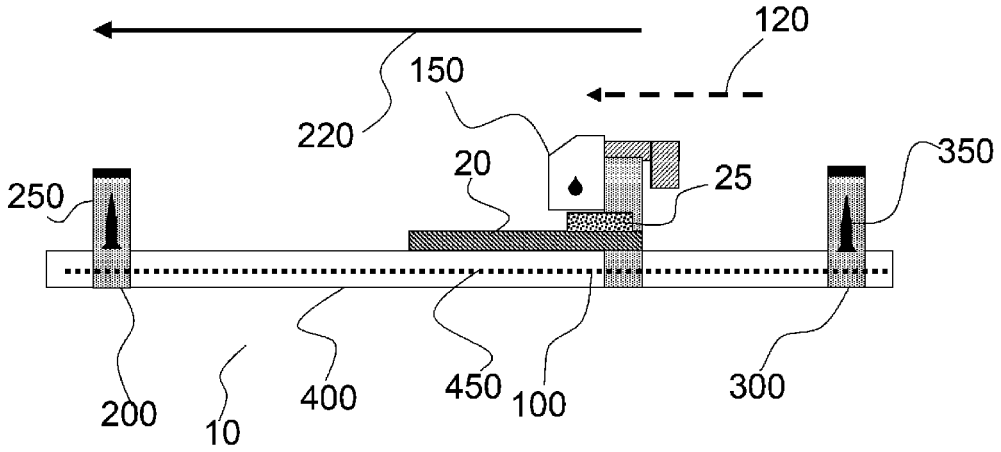
Figure 4:
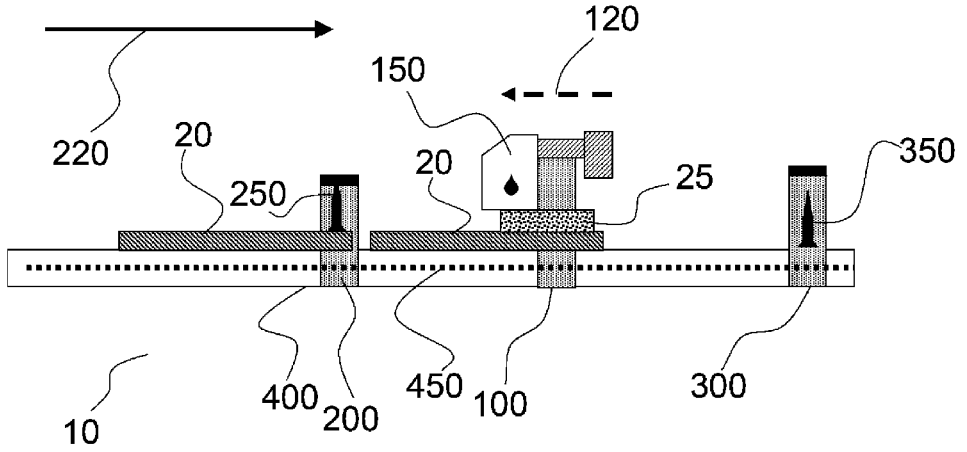
Figure 5:
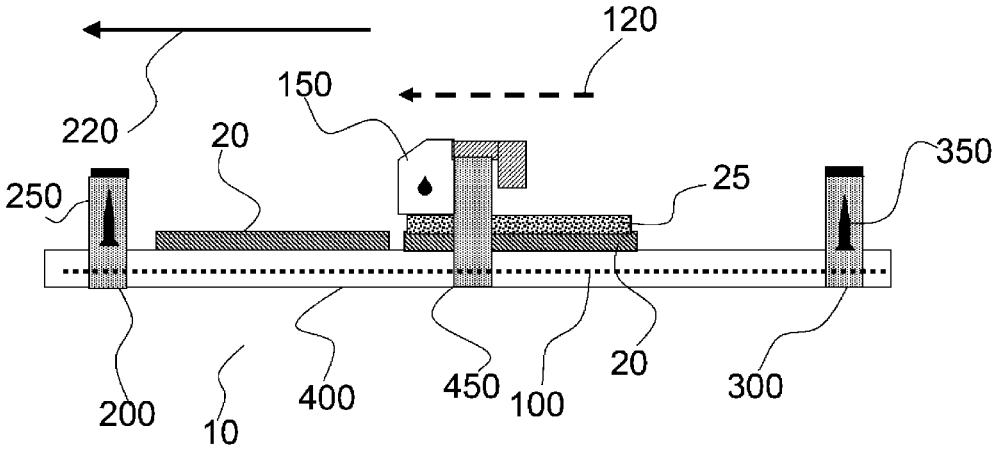

FIG. 1 illustrates an initial state of the inkjet printing device (10); the loading of the ink-receivers (20) is illustrated from FIG. 2 until FIG. 5; the printing is illustrated from FIG. 3 until FIG. 7 and the unloading of a print-finished ink-receiver (illustrated as an ink-receiver (20) with on top an ink layer (25)) from FIG. 6 until FIG. 7. The illustrated preferred embodiment shows the ability to load and print simultaneously and print and unload simultaneously which causes an advantage in volume printing production. The same use of the rail (450) makes it more easy for calibrate the movements of the gantries (100, 200, 300).

Figure 8:
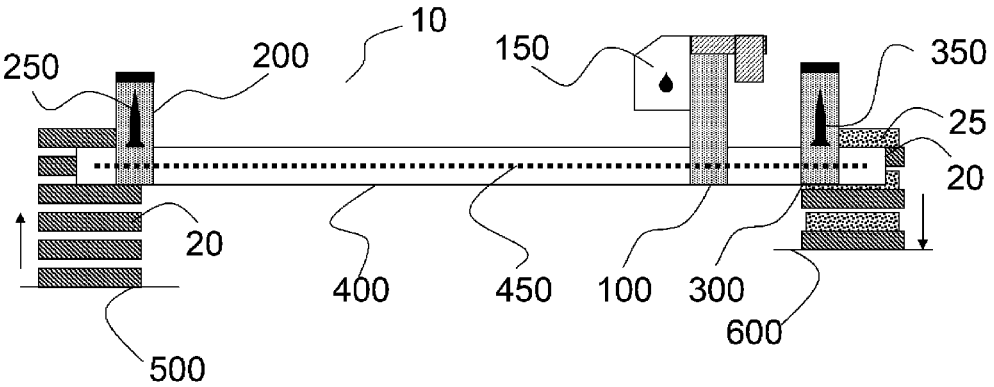
FIG. 8 and FIG. 9 illustrate a same preferred embodiment of an inkjet printing device (10), which is not visible.
Figure 9:
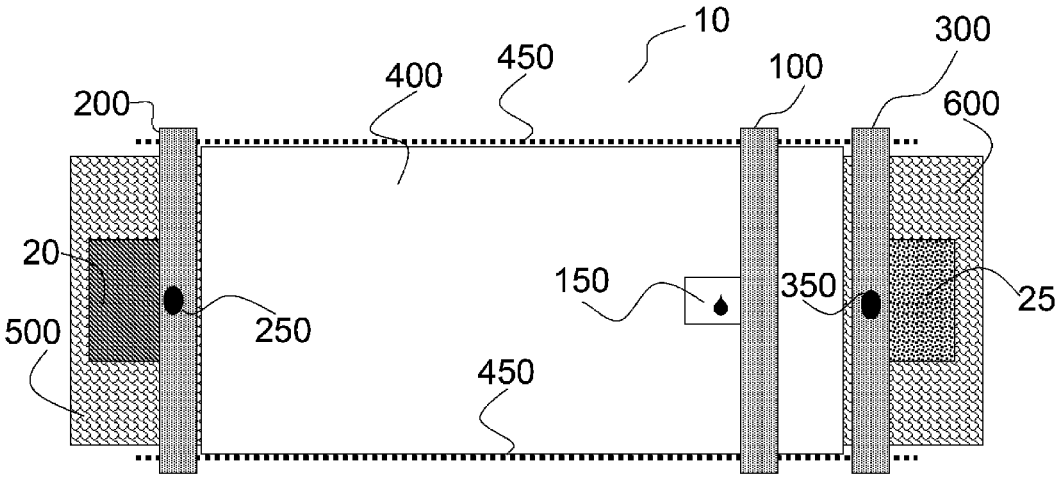

FIG. 8 is a cross-section and FIG. 9 is a top-view of the preferred inkjet printing device. The to-be-loaded ink-receivers (25) are stacked on an input tray (500). The input gantry (200) is capable of coupling an ink-receiver (25) from the input tray by an ink-receiver coupler (250) to load the ink-receiver (25) on the flatbed table (400) while moving the input tray (500) on a set of rails (450). The print gantry (100) comprising a print head (150) and the output gantry (300) move on the same set of rails (450). The output gantry (300) is capable of coupling a print-finished ink-receiver, (illustrated as an ink-receiver (20) with on top an ink layer (25)) by an ink-receiver coupler (350) and unloading the print-finished ink-receiver from the flatbed table (400) to an output tray (600).

A preferred embodiment of the present invention is an inkjet printing device (10) comprising:

a fast-scan drive module, attached to a first gantry (100), for moving back-and-forth, parallel to a first direction above a flatbed table (400), a print head (150), comprising a nozzle row; and wherein the first direction is perpendicular to the nozzle row; and a slow-scan drive module, attached to the Inkjet printing device (10), for moving back-and-forth (120) above the flatbed table (400), parallel to a second direction, the first gantry (100) on a set of motion rails (450), attached to the Inkjet printing device (10); and wherein the second direction is perpendicular to the first direction; and a first drive module, attached to a second gantry (200), for moving (220) parallel to the second direction the second gantry (200) on the set of motion rails (450) while an ink-receiver (20) is coupled to the second gantry (200); and loading the ink-receiver (20) on the flatbed table (400) by decoupling the ink-receiver (20) from the second gantry (200). The first drive module is also called an input module. The ink-receiver (20) is coupled to the second gantry (200) by an ink-receiver coupler (220) which may be a suction cup or clamp. If the ink-receivers (20) are magnetisable, also an electro-magnet may be used as ink-receiver coupler (220) by switching on the electro-magnet.

The first direction is also called the fast-scan direction and the second direction is also called the slow-scan direction. Other name for the second gantry (200) is loading gantry or input gantry. The slow-scan direction is parallel to the input-to-output direction of the ink-receivers (50), also called print direction. Other name for the first gantry is print gantry. Methods to move a gantry along a set of motion rails are known in the state-of-the-art, such as linear actuator technologies with linear movements guided by a rail.

A preferred embodiment of the present invention is also an inkjet printing method comprising the steps:

moving a print head (150), comprising a nozzle-row and attached to a first gantry (100), back-and-forth and parallel to a first direction above a flatbed table (400); and wherein the first direction is perpendicular to the nozzle row; and moving the first gantry (100), attached to an Inkjet printing device (10), back-and-forth on a set of motion rails (450) and parallel to a second direction above a flatbed table (400); and wherein the second direction is perpendicular to the first direction: and coupling an ink-receiver (20) to a second gantry (200); and moving the second gantry (200) parallel to the second direction on the set of motion rails (450) while the ink-receiver (20) is coupled to the second gantry (200); and loading the ink-receiver (20) on the flatbed table (400) by decoupling the ink-receiver (20) from the second gantry (200). In a more preferred embodiment the coupling to the second gantry (200) of the ink-receiver (20) is from a first tray (500). The first tray (500), also called input tray (500), can be an external feeding station attached to the flatbed table (400) or ink-receiver stacker, also called a substrate stacker, comprising a plurality of ink-receivers (20).

The main advantage of the present invention is the independent movement of the several gantries in the inkjet printing device (10) but still connected to the inkjet printing device (10) so any trilling, status, error state can be monitored and sent to the several gantries which makes the conditioning, such as temperature conditions, of the inkjet printing device (10) much easier than the inkjet printing devices in the state-of-the-art. Similar mechanical tolerances for the several gantries can be achieved. Especially when the same set of rails (450) is used for the print gantry and input gantry the mechanical tolerances shall become the same for both gantries. The same set of rails (450) may be used for the print gantry and output gantry so the mechanical tolerances shall become the same for both gantries. Several gantries, attachable to the inkjet print device (10) such as input gantry (200) and output gantry (300) are described below as preferred embodiments.

In a preferred embodiment a gantry, such as input gantry (100) or output gantry (200) is easily attachable to the set of rails (450) whereon the print gantry is moving along in the slow-scan direction, for example by a click-system or the ability to push or shove the gantry on the set of rails (450). The gantry is more preferably a plug-and-play gantry which means that it facilitates the discovery of the gantry in the inkjet printing device (10) without the need for physical device configuration or operator intervention in resolving resource conflicts. Preferably the power supply is on the set of rails (450) so each gantry on this set of rails (450) has the capability to use this power supply.

Another advantage of the several gantries (100, 200, 300) in the embodiment and preferred embodiments is that possibility to control the thermoregulation and/or bearing from the several gantries (100, 200, 300) differently and independently. The weight of the set of print heads attached to the print gantry together with the liquids for jetting may not be underestimated.

The accuracy of movement and position is very important in an inkjet printing device because any deviation may cause for example color-on-color misregistration, banding, gloss differences so the use of the same set of rails is a breakthrough and it has also the advantage that the position of each gantry is exactly known. This may become a higher advantage when an encoder-strip is mounted on the set of rails. No extra calibrations, for example position calibration; between the several gantries is then also not needed. It is known that movement deviation of a gantry can occur, for example due to small deviations in linearity of the rails. These movement deviations can be solved after calibrating the movement of a gantry. Because the same rails are used the calibration can be faster performed on all the gantries on the same rails.

In a preferred embodiment multiple ink-receivers (20) may be coupled to the second gantry (200), moved above the flatbed table (400) and loaded simultaneously on the flatbed table (400).

In a preferred embodiment the inkjet printing device (10) comprises a second drive module, attached to a third gantry (300) for unloading a print-finished ink-receiver from the flatbed table (400) by coupling the print-finished ink-receiver to the third gantry (300); and moving parallel to the second direction the third gantry (300) on the set of motion rails (450) or another set of motion rails while the print-finished ink-receiver is coupled to the third gantry (300). The second drive module is also called an output module. The ink-receiver (20) is coupled to the third gantry (300) by an ink-receiver coupler (320) which may be a suction cup or clamp. If the ink-receivers (20) are magnetisable, also an electro-magnet may be used as ink-receiver coupler (320) by switching on the electro-magnet. The other set of motion rails are attached to the inkjet printing device (10).

Other name for the second gantry is unloading gantry, picking gantry or output gantry. The slow-scan direction is parallel to the input-to-output direction of the ink-receivers (50), also called print direction.

Or also a preferred embodiment of the inkjet printing method comprises the following steps:

unloading a print-finished ink-receiver from the flatbed table (400) by coupling the print-finished ink-receiver to a third gantry (300); and moving the third gantry (300) parallel to the second direction on the set of motion rails (450) or another set of motion rails while the ink-receiver (20) is coupled to the third gantry (300); and decoupling the print-finished ink-receiver from the third gantry (300).

In a more preferred embodiment the decoupling from the second gantry (200) of the ink-receiver (20) is to a second tray (600). The second tray (600), also called output tray (600), can be an external output station attached to the flatbed table (400) or ink-receiver stacker, also called a substrate stacker, comprising a plurality of print-finished ink-receivers (20). The other set of motion rails are attached to the inkjet printing device (10).

In a preferred embodiment multiple print-finished ink-receivers (20) may be coupled to the third gantry (300), moved above the flatbed table (400) and unloaded simultaneously from the flatbed table (400).

In a preferred embodiment of the present invention the input module is comprised in an auto-loader for automatic loading ink-receivers (20) by checking free space on the flatbed table (400), reachable by the second gantry (200), based on:

determination of loading time derived from a dimension of the ink-receiver (20); and determination of position from the first gantry (100) in the loading time; and determination of the reachable free space on the flatbed table (400) in the loading time.

The dimension of the ink-receiver (20) is in the determination of the loading time preferably parallel to the second direction.

If a preferred embodiment comprises an output module than in a more preferred embodiment the output is comprised in the same auto-loader or another auto-loader for automatic unloading print-finished ink-receivers (20) by checking loaded space on the flatbed table (400), reachable by the third gantry (300), based on:

determination of unloading time derived from a dimension of a print-finished ink-receiver on the flatbed table (400); and determination of position from the first gantry (100) in the unloading time; and determination of the reachable loaded space in the unloading time.

Also in this more preferred embodiment the dimension of the ink-receiver (20) is in the determination of the unloading time preferably parallel to the second direction.

The automating of loading ink-receivers (50) and unloading print-finished ink-receivers is economically a big advantage because the productivity of the inkjet printing device (10) becomes higher. The use of the same set of rails makes the manufacturing of such inkjet printing device (10) much cheaper.

In a preferred embodiment the first drive module may also unloading print-finished ink-receiver from the flatbed table (400) by coupling the ink-receiver (20) to the second gantry (200). So the first drive module is not only an input module for loading ink-receivers (20) on the flatbed table (400) but also an output module for unloading ink-receivers (20) from the flatbed table. More preferably the input module is comprised in an auto-loader for automatic loading ink-receivers (20) by checking free space on the flatbed table (400), reachable by the second gantry (200), based on:

determination of loading time derived from a dimension of the ink-receiver (20); and determination of position from the first gantry (100) in the loading time; and determination of the reachable free space on the flatbed table (400) in the loading time; and for automatic unloading print-finished ink-receivers (20) by checking loaded space on the flatbed table (400), reachable by the second gantry (200), based on:

determination of unloading time derived from a dimension of a print-finished ink-receiver on the flatbed table (400); and determination of position from the first gantry (100) in the unloading time; and determination of the reachable loaded space in the unloading time.

Also in this more preferred embodiment the dimension of the ink-receiver (20) is in the determination of the loading and unloading time preferably parallel to the second direction.

In a preferred embodiment the determination of reachable free space on the flatbed table (400) comprises the step of imaging loaded ink-receivers (20) on the flatbed table (400) by an image device, such as a digital camera, to determine the positions of the loaded ink-receivers (20).

In a preferred embodiment the determination of reachable loaded space on the flatbed table (400) comprises the step of imaging loaded ink-receivers (20) on the flatbed table (400) by an image device, such as a digital camera, to determine the positions of the loaded ink-receivers (20).

The present invention and its preferred embodiments boost the volume production with serious heights. They make it possible to load, unload and/or print ink-receivers simultaneously (see FIG. 1 to FIG. 7), with a minimal calibration and minimal deviations so optimal print quality and ink-receiver handling can be achieved.

Drying Gantry

In the state-of-the-art of moving gantry flatbed table inkjet printers a drying source is attached to the scanning print head (150) whereby the jetted ink from the scanning print head (150) is immobilized, such as pin dried. The drying source is in a preferred embodiment a drying source selected from the group UV bulb lamp, IR dryer, NIR dryer, SWIR dryer, UV LED, UV-A LED, UV-B LED, UV-C LED and carbon infrared emitter and in a more preferred embodiment a combination of minimum 2 drying sources selected from the group UV bulb lamp, IR dryer, NIR dryer, SWIR dryer, UV LED, UV-A LED, UV-B LED, UV-C LED and carbon infrared emitter. Some drying sources are good for drying the top and other drying sources are more preferred for depth drying, so a combination of such both drying sources is a real advantage due to the thickness of multi-colored ink layers in the state-of-the-art inkjet printing devices.

This preferred embodiment and more preferred embodiment may comprise another gantry, also called drying gantry, which moves back-and-forth parallel to the second direction on the set of motion rails (450) or another set of motion rails. The same set of motion rails (450) is the most preferred embodiment. The drying gantry comprises a drying source which is selected from the group UV bulb lamp, IR dryer, NIR dryer, SWIR dryer, UV LED, UV-A LED, UV-B LED, UV-C LED and carbon infrared emitter and in a more preferred embodiment a combination of minimum two drying sources selected from the group UV bulb lamp, IR dryer, NIR dryer, SWIR dryer, UV LED, UV-A LED, UV-B LED, UV-C LED and carbon infrared emitter. Some drying sources are good for drying the top and other drying sources are more preferred for depth drying, so a combination of such both drying sources is a real advantage due to the thickness of multi-colored ink layers in the state-of-the-art inkjet printing devices. The drying source on the drying gantry is for immobilizing, such as pin drying, the ink layers (25) on the ink-receivers (50).

The drying gantry is preferably used for full drying the jetted layer (25) on the ink-receivers (50) before unloading the print-finished ink-receivers by an operator or an output gantry, as described above.

The drying gantry may comprise another fast-scan drive module, attached to the drying gantry, for moving back-and-forth, parallel to the fast-scan direction above a flatbed table (400), the drying source.

To avoid a 'traffic jam' with the plurality of gantries and to optimize the production volume on the inkjet printing device (10) the reachable areas on the flatbed table (400) have to determined for each gantry, such as prescribed in the preferred embodiment of the auto-loader.

The advantage of a drying gantry is that possibility to control the thermoregulation from the drying gantry and the print (gantry) differently and independently.

In a preferred embodiment the drying gantry may be coupled to the print gantry so the gantry moves together with the print gantry while printing.

Cutting Gantry

With the plurality of gantries in the prescribed preferred embodiments of the present invention, the moving gantry flatbed table inkjet printer may comprise another gantry whereon a cut source is attached movable by a drive module along the gantry. Such another gantry is called a cutting gantry. The cutting gantry is back-and-forth movable on the set of moving rails (450) or another set of moving rails in a direction parallel to the slow-scan direction. The same set of motion rails (450) is the most preferred embodiment.

To avoid a 'traffic jam' with the plurality of gantries and to optimize the production volume on the inkjet printing device (10) the reachable areas on the flatbed table (400) have to determined for each gantry, such as prescribed in the preferred embodiment of the auto-loader. The combination of a print gantry and a cutting gantry is not ideal by the dust generation while cutting which causes contamination on the nozzles of the print heads (150) so in a preferred embodiment also a vacuum cleaner is attached to the cut source.

In a preferred embodiment the cutting gantry may be coupled to the output gantry so the cutting gantry moves together with the output gantry.

In a preferred embodiment the cutting gantry may be coupled to the print gantry so the cutting gantry moves together with the print gantry.

The advantage of a drying gantry is that possibility to control the thermoregulation and/or bearing from the cutting gantry and the print gantry (100) differently and independently.

Plasma Treatment Gantry

With the plurality of gantries in the prescribed preferred embodiments of the present invention, the moving gantry flatbed table inkjet printer may comprise another gantry whereon a plasma treatment source is attached which may move by a drive module along the gantry. Such another gantry is called a plasma treatment gantry. The plasma treatment gantry is back-and-forth movable on the set of moving rails (450) or another set of moving rails in a direction parallel to the slow-scan direction. The same set of motion rails (450) is the most preferred embodiment.

The plasma treatment source preferably comprises a rotating head having at least one eccentrically disposed plasma nozzle for generating a plasma jet directed in parallel with the axis of rotation. The nozzle includes a swirl system for swirling the plasma jet. More information of such kind of source is described in U.S. Pat. No. 6,265,690 (COTTIN DEVELOPMENT LTD).

To avoid a 'traffic jam' with the plurality of gantries and to optimize the production volume on the inkjet printing device (10) the reachable areas on the flatbed table (400) have to determined for each gantry, such as prescribed in the preferred embodiment of the auto-loader.

In a preferred embodiment the plasma treatment gantry may be coupled to the input gantry so the plasma treatment gantry moves together with the input gantry.

In a preferred embodiment the plasma treatment gantry may be coupled to the print gantry so the plasma treatment gantry moves together with the print gantry.

The advantage of a drying gantry is that possibility to control the thermoregulation and/or bearing from the cutting gantry and the print gantry (100) differently and independently.

Other Preferred Gantries

The moving gantry flatbed table inkjet printer may comprise other gantries moving on a set of rails, more preferably on the same set of rails as the print gantry:

cleaning gantry to clean the flatbed table (400) and/or loaded ink-receivers (20); and/or nozzle cleaning gantry to clean the nozzles of a print head (150); and/or coating gantry to coat the loaded ink-receivers (20) on the flatbed table (400) with a coating, preferably an inkjet absorbing coating; and/or varnish gantry to varnish the print-finished ink-receivers on the flatbed table (400); and/or impregnation gantry to impregnate loaded ink-receivers and/or print-finished ink-receivers with a liquid; and/or anti-static gantry to remove static charges on loaded ink-receivers and/or print-finished ink-receivers or flatbed table (400) wherein the anti-static gantry may comprise a drive module to move back-and-forth an ionization nozzle or ionization gun parallel to the fast-scan direction; and/or flame-plasma-treatment gantry to treat ink-receivers and/or print-finished ink-receivers with flammable gas and surrounding air.

These gantries may be coupled to other gantries such as the input gantry (200), print gantry (100) or output gantry (300).

To avoid a 'traffic jam' with the plurality of gantries and to optimize the production volume on the inkjet printing device (10) the reachable areas on the flatbed table (400) have to determined for each gantry, such as prescribed in the preferred embodiment of the auto-loader.

The advantage of the several gantries is that possibility to control the thermoregulation and/or bearing from the several gantries differently and independently.

Other Preferred Embodiments

The input gantry (200) may be coupled to the print gantry (100). When an ink-receiver (20) is coupled to the input gantry (200) and the input gantry (200) is coupled to the print gantry (100), the ink-receiver (20) may be moved with the print gantry in the print direction and may be loaded on the flatbed table (400). With this method the productivity is gained.

The output gantry (300) may be coupled to the print gantry (100). When a print-finished ink-receiver is coupled to the output gantry (300) and the output gantry (300) is coupled to the print gantry (100), the ink-receiver (20) may be moved with the print gantry in the print direction and may be unloaded from the flatbed table (400). With this method the productivity is gained.

The coupling and decoupling is performed by a gantry coupling means which may comprise an electro magnet to couple both gantries with magnetic force.

To hold down a loaded ink-receiver (50) the flatbed table (400) is a vacuum table. Preferably the vacuum table comprises a plurality of vacuum zones. More info on multiple vacuum zones on a vacuum table is disclosed in WO2015067520 (AGFA GRAPHICS NV).

Flatbed Table (400)

A flatbed table (400) is a support for an ink-receiver (20) while an inkjet printing system is printing on the ink-receiver (20). The support of ink-receivers (20) has to be flat to print on large ink-receivers (20). A flatbed table (400) comprises a base unit. The base unit is preferably stable and robust. It comprises fixing means suitable for attaching to an inkjet printing system. To have a strong, stable and robust base unit, the base unit comprises preferably metal such as steel or aluminium. The support layer may have any shape but is preferably rectangular shaped. The size of the support layer from the flatbed table (400) is preferably from 2.50 until 20.0 $m^2$, more preferably from 2.80 until 15.0 $m^2$ and most preferably from 3.00 until 10.0 $m^2$. The larger the size of the support layer, the larger an ink-receiver (20) or more ink-receivers (20) can be supported which results in a production boost. Larger the size of the support layer, more difficult to achieve a flatness less than 300 μm at a cost-effective production of flatbed tables (400). The width or height of the flatbed table (400) is preferably from 1.0 m until 10 m. The larger the width and/or height, the larger the ink-receiver (20) may be supported by the flatbed table (400) which is an economical benefit.

Preferably the flatbed table (400) of the embodiment comprises a honeycomb structure plate which is sandwiched between a top and bottom sandwich plate. The top sandwich plate is preferably the top of the base unit. The weight of such flatbed table (400) and base unit is low because the weight of a honeycomb structure is lower than a solid flatbed table (400), especially when the support layer of the flatbed table (400) is at least 1.5 $m^2$. This results in easier manipulation and manufacturing of the flatbed table (400) or inkjet printing system wherein such a flatbed table (400) is constructed. A honeycomb structure plate results also in high stability and less bending of the flatbed table (400) (=better flatness). To achieve high stability the honeycomb structure plate comprises preferably metal such as aluminium. The honeycomb cores are preferably sinusoidal or hexagonal shaped to provide maximum stiffness in several directions so the forces caused by the support of the ink-receivers (20) are distributed over the surface area of the support layer from the flatbed table (400). The flatness of the top sandwich plate (600) is preferably less than 1.2 mm and more preferably less than 0.6 mm which makes the amount of abrasion in the manufacturing method of the present invention less time-consuming.

The flatbed table (400) in the embodiment may be wrapped by a porous conveyor belt, linked by minimal 2 pulleys, wherein the porous conveyor belt carries the ink-receiver (20) by moving from a start location to an end location. Preferably the porous conveyor belt moves the ink-receiver (20) in successive distance movements also called discrete step increments. The flatbed table (400) results in a flat support for the ink-receiver (20) on the porous conveyor belt while printing.

The width of the printing table in the embodiment is equal to the dimension of the side of the printing table where the ink-receiver (20) enters on the flatbed table (400). The length of the porous flatbed table (400) is equal to the dimension of the side perpendicular to the side of the printing table where the ink-receiver (20) enters on the flatbed table (400).

The flatness on the top of the support layer is crucial to have good print quality on an ink-receiver (20) which is supported on the support layer because it influences the throw distance.

To measure the flatness of a flatbed table (400), several flatness measurement tools are available in the state-of-the art, for example the measurement tool disclosed in U.S. Pat. No. 6,497,047 (FUJIKOSHI KIKAI KOGYO KK).

The flatness of a flatbed table (400) can also be measured by surface profilometers such as the KLA-Tencor™ series of bench top stylus and optical surface profilometers.

In the preferred embodiments any set of rails is attached to the flatbed table (400). The number of rails is preferably two which are attached to both sides, parallel to the slow-scan direction, of the flatbed table (400). The heavy gantries moving on these set of rails and the accuracy of these 'straight' movements needs to be very high so these two rails are advantageous. It solves also the beam stress on these gantries.

Several methods how to move along a rail are well-known in the state-of-the-art such as gear rails and mono rails.

The rails are preferably extended (see FIG. 8 and FIG. 9) at the input side of the flatbed table (400) so an input tray can easily coupled to the inkjet printing device (10).

The rails are preferably extended (see FIG. 8 and FIG. 9) at the output side of the flatbed table (400) so an output tray can easily coupled to the inkjet printing device (10).

Inkjet Printing Device (10)

An inkjet printing device (10), such as an inkjet printer, is a marking device that is using a print head (150) or a print head (150) assembly with one or more print heads (150), which jets a liquid, as droplets or vaporized liquid, on a ink-receiver. A pattern that is marked by jetting of the inkjet printing device (10) on an ink-receiver is preferably an image. The pattern may be achromatic or chromatic colour.

A preferred embodiment of the inkjet printing device (10) is that the inkjet printing device (10) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing. Wide format printers generally use a roll of ink-receiver rather than individual sheets of ink-receiver but today also wide format printers exist with a flatbed table (400), called a flatbed, whereon ink-receiver is loaded. A wide-format printer preferably comprises a belt step conveyor system.

A flatbed table (400) in the inkjet printing device (10) may move under a print head (150) or a gantry may move a print head (150) over the flatbed table (400). These so called flatbed table inkjet printers most often are used for the printing of planar ink-receivers, ridged ink-receivers and sheets of flexible ink-receivers. They may incorporate IR-dryers or UV-dryers to prevent prints from sticking to each other as they are produced. An example of a wide-format printer and more specific a flatbed table inkjet printer is disclosed in EP1881903 B (AGFA GRAPHICS NV).

The inkjet printing device (10) may mark a broad range of ink-receivers (20) such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, plastic foils, transparency foils, adhesive PVC sheets, impregnated paper and others. An ink-receiver may comprise an inkjet acceptance layer. An ink-receiver may be a paper substrate or an impregnated paper substrate or a thermosetting resin impregnated paper substrate.

Preferably the inkjet printing device (10) comprises one or more print heads (150) jetting UV curable ink to mark ink-receiver and a UV source (=Ultra Violet source), as dryer source, to cure the inks after marking. Spreading of a UV curable inkjet ink on an ink-receiver may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a ink-receiver in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

Any ultraviolet light source, as long as part of the emitted light can be absorbed by the photoinitiator or photoinitiator system, may be employed as a radiation source, such as a high or low pressure mercury lamp, a cold cathode tube, a black light, an ultraviolet LED, an ultraviolet laser, and a flash light. Of these, the preferred source is one exhibiting a relatively long wavelength UV-contribution having a dominant wavelength of 300-400 nm. Specifically, a UV-A light source is preferred due to the reduced light scattering therewith resulting in more efficient interior curing. UV radiation is generally classed as UV-A, UV-B, and UV-C as follows:

UV-A: 400 nm to 320 nm
UV-B: 320 nm to 290 nm
UV-C: 290 nm to 100 nm.

In a preferred embodiment, the inkjet printing device (10) contains one or more UV LEDs with a wavelength larger than 360 nm, preferably one or more UV LEDs with a wavelength larger than 380 nm, and most preferably UV LEDs with a wavelength of about 395 nm.

Furthermore, it is possible to cure the image using, consecutively or simultaneously, two light sources of differing wavelength or illuminance. For example, the first UV-source can be selected to be rich in UV-C, in particular in the range of 260 nm-200 nm. The second UV-source can then be rich in UV-A, e.g. a gallium-doped lamp, or a different lamp high in both UV-A and UV-B. The use of two UV-sources has been found to have advantages e.g. a fast curing speed and a high curing degree.

For facilitating curing, the inkjet printing device (10) often includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

The inkjet printing device (10) may comprise an IR source (=Infra Red source) to solidify the ink by infra-red radiation. The IR source is preferably a NIR source (=Near Infra Red source) such as a NIR lamp or a SWIR (=Short Wave Infra Red source) such as a SWIR map. The IR source may comprise carbon infrared emitters which has a very short response time.

The IR source or UV source in the above preferred embodiments create a drying zone on the vacuum belt to immobilize jetted ink on the ink-receiver.

The inkjet printing device (10) may comprise corona discharge equipment to treating the ink-receiver before the ink-receiver passes a print head (150) of the inkjet printing device (10) because some ink-receivers have chemically inert and/or nonporous top-surfaces leading to a low surface energy which may result in bad print quality.

The terms "partial dry", "pin dry", and "full dry" refer to the degree of drying, i.e, the percentage of converted functional groups, and may be determined by for example RT-FTIR (Real-Time Fourier Transform Infra-Red Spectroscopy) a method well known to the one skilled in the art of drying formulations. A partial dry, also called a pin dry, is defined as a degree of curing wherein at least 5%, preferably at least 10%, of the functional groups in the coated formulation is converted. A full dry is defined as a degree of drying wherein the increase in the percentage of converted functional groups, with increased exposure to radiation (time and/or dose), is negligible. A full dry corresponds with a conversion percentage that is within 10%, preferably within 5%, from the maximum conversion percentage defined by the horizontal asymptote in the RT-FTIR graph (percentage conversion versus curing energy or drying time).

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed ink-receivers (200), but also to primed ink-receivers (200).

Vacuum Chamber

A vacuum chamber is a rigid enclosure which is constructed by many materials preferably it may comprise a metal. The choice of the material is based on the strength, pressure and the permeability. The material of the vacuum chamber may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, ink-receiver fibers, ink, ink residues and/or ink debris such as cured ink, to contaminate via the set of air-channels (605) of the flatbed table (400) the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Inkjet Vacuum Table

To avoid registration problems while printing on an ink-receiver and to avoid collisions while conveying an ink-receiver, the ink-receiver needs to be connected to a flatbed table (400). An inkjet vacuum table is a flatbed table (400) wherein the ink-receiver is connected to the flatbed table (400) by vacuum pressure. An inkjet vacuum table is also called a porous flatbed table (400).

Preferably the inkjet vacuum table in the embodiment comprises a set of air-channels to provide a pressure differential by a vacuum chamber at the support layer of the inkjet vacuum table to create a vacuum zone and at the bottom-surface of the flatbed table (400) a set of apertures which are connected to the set of air-channels. These apertures at the bottom layer may be circular, elliptical, square, rectangular shaped and/or grooves, such as slits, parallel with the bottom layer of the inkjet vacuum table.

The width or height of the inkjet vacuum table is preferably from 1.0 m until 10 m. The larger the width and/or height, the larger the ink-receiver may be supported by the inkjet vacuum table which is an economical benefit.

A set of apertures at the support layer of the inkjet vacuum table may be connected to the air-channels. These apertures at the support layer may be circular, elliptical, square, rectangular shaped and/or grooves, such as slits, parallel with the support layer of the inkjet vacuum table. Preferably, if the apertures are grooves, the grooves are oriented along the printing direction of the inkjet printing device (10).

Preferably the inkjet vacuum table of the embodiment comprising a honeycomb structure plate which is sandwiched between a top and bottom sandwich plate which comprises each a set of apertures connect to one or more air-channels in the inkjet vacuum table. The honeycomb cores, as part of the air-channels, in the honeycomb structure plate results in a better uniform vacuum distribution on the support surface of the inkjet vacuum table.

The dimensions and the amount of air-channels should be sized and frequently positioned to provide sufficient vacuum pressure to the inkjet vacuum table. Also the dimensions and the amount of apertures at the bottom-surface of the inkjet vacuum table should be sized and frequently positioned to provide sufficient vacuum pressure to the inkjet vacuum table. The dimension between two air-channels or two apertures at the bottom-surface of the inkjet vacuum table may be different. A honeycomb core is preferably sinusoidal or hexagonal shaped.

If a honeycomb structure plate is comprised in the inkjet vacuum table also the dimensions and the amount of honeycomb cores should be sized and frequently positioned to provide sufficient vacuum pressure to the inkjet vacuum table. The dimensions between two neighbour honeycomb cores may be different.

The support layer of the flatbed table (400) should be constructed to prevent damaging of an ink-receiver. For example the apertures at the support layer that are connected with the air-channels may have rounded edges. The support layer of the flatbed table (400) may be configured to have low frictional specifications.

The inkjet vacuum table is preferably parallel to the ground whereon the inkjet printing system is connected to avoid misaligned printed patterns.

The top-surface of the inkjet vacuum table or a portion of the inkjet vacuum table, such as the inner side of its air-channels may be coated to have easy cleaning performances e.g. as result of dust or ink leaks. The coating is preferably a dust repellent and/or ink repellent and/or hydrophobic coating. Preferably the top-surface of the inkjet vacuum table or a portion of the inkjet vacuum table, such as the inner side of its air-channels, is treated with an ink repelling hydrophobic method by creating a lubricious and repelling surface which reduces friction.

In a preferred embodiment the inkjet vacuum table comprises a plurality of vacuum zones and more preferably variable sized vacuum zones.

A vacuum zone may in a preferred embodiment change independently its vacuum power to hold down an ink-receiver (20) even-more or ease the de-coupling of the ink-receiver (20) from a gantry.

Each vacuum zone may in a preferred embodiment change in a positive pressure, such as air blowing, to coupling n print-finished ink-receiver from the inkjet vacuum table to a gantry.

Each vacuum zone may in a preferred embodiment change in a positive pressure, such as air blowing, to create an air cushion to ease the loading of an ink-receiver (20) on the inkjet vacuum table and/or unloading the ink-receiver (20) from the inkjet vacuum table and/or the movement of the ink-receiver (20) above the inkjet vacuum table when coupled to a gantry.

In a preferred embodiment the inkjet vacuum table comprises a plurality of air cushion zones and more preferably variable sized air cushion zones.

An air cushion zone may in a preferred embodiment change independently its air cushion power to ease the loading of an ink-receiver (20) on the inkjet vacuum table and/or unloading the ink-receiver (20) from the inkjet vacuum table and/or the movement of the ink-receiver (20) above the inkjet vacuum table when coupled to a gantry.

Print Head (150)

A print head (150) is a means for jetting a liquid on an ink-receiver through a nozzle. The nozzle may be comprised in a nozzle plate which is attached to the print head (150). A print head (150) preferably has a plurality of nozzles which may be comprised in a nozzle plate. A set of liquid channels, comprised in the print head (150), corresponds to a nozzle of the print head (150) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a print head (150) is also called a jettable liquid.

The way to incorporate print heads (150) into an inkjet printing device (10) is well-known to the skilled person.

A print head (150) may be any type of print head (150) such as a Valvejet print head, Piezoelectric print head, thermal print head (150), a continuous print head (150) type, electrostatic drop on demand print head (150) type or acoustic drop on demand print head (150) type or a page-wide print head (150) array, also called a page-wide inkjet array.

A print head (150) comprises a set of master inlets to provide the print head (150) with a liquid from a set of external liquid feeding units. Preferably the print head (150) comprises a set of master outlets to perform a recirculation of the liquid through the print head (150). The recirculation may be done before the droplet forming means but it is more preferred that the recirculation is done in the print head (150) itself, so called through-flow print heads (150). The continuous flow of the liquid in a through-flow print heads (150) removes air bubbles and agglomerated particles from the liquid channels of the print head (150), thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow print head (150) is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the print head (150) wherein the mixing means is attached to the set of master inlets and the set of liquid channels. The mixing means may comprise a stirring device in a liquid container, such as a manifold in the print head (150), wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the print head (150). The droplet forming means are activating the liquid channels to move the liquid out the print head (150) through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The print head (150) of the present invention is preferably suitable for jetting a liquid having a jetting viscosity of 8 mPa·s to 3000 mPa·s. A preferred print head (150) is suitable for jetting a liquid having a jetting viscosity of 20 mPa·s to 200 mPa·s; and more preferably suitable for jetting a liquid having a jetting viscosity of 50 mPa·s to 150 mPa·s.

Valvejet Print Head

A preferred print head (150) for the present invention is a so-called Valvejet print head. Preferred valvejet print heads (150) have a nozzle diameter between 45 and 600 μm. The valvejet print heads (150) comprising a plurality of micro valves, allow for a resolution of 15 to 150 dpi that is preferred for having high productivity while not comprising image quality. A valvejet print head is also called coil package of micro valves or a dispensing module of micro valves. The way to incorporate valvejet print heads (150) into an inkjet printing device (10) is well-known to the skilled person. For example, US 2012105522 (MATTHEWS RESOURCES INC) discloses a valvejet printer including a solenoid coil and a plunger rod having a magnetically susceptible shank. Suitable commercial Valvejet print heads (150) are chromoJET™ 200, 400 and 800 from Zimmer, Printos™ P16 from VideoJet and the coil packages of micro valve SMLD 300's from Fritz Gyger™. A nozzle plate of a Valvejet print head is often called a faceplate and is preferably made from stainless steel.

The droplet forming means of a valvejet print head controls each micro valve in the valvejet print head by actuating electromagnetically to close or to open the micro valve so that the medium flows through the liquid channel. Valvejet print heads (150) preferably have a maximum dispensing frequency up to 3000 Hz.

In a preferred embodiment the valvejet print head the minimum drop size of one single droplet, also called minimal dispensing volume, is from 1 nL (=nanoliter) to 500 μL (=microliter), in a more preferred embodiment the minimum drop size is from 10 nL to 50 μL, in a most preferred embodiment the minimum drop size is from 10 nL to 300 μL. By using multiple single droplets, higher drop sizes may be achieved.

In a preferred embodiment the valvejet print head has a native print resolution from 10 DPI to 300 DPI, in a more preferred embodiment the valvejet print head has a native print resolution from 20 DPI to 200 DPI and in a most preferred embodiment the valvejet print head has a native print resolution from 50 DPI to 200 DPI.

In a preferred embodiment with the valvejet print head the jetting viscosity is from 8 mPa·s to 3000 mPa·s more preferably from 25 mPa·s to 1000 mPa·s and most preferably from 30 mPa·s to 500 mPa·s.

In a preferred embodiment with the valvejet print head the jetting temperature is from 10° C. to 100° C. more preferably from 20° C. to 60° C. and most preferably from 25° C. to 50° C.

Piezoelectric Print Heads

Another preferred print head (150) for the present invention is a piezoelectric print head. Piezoelectric print head, also called piezoelectric inkjet print head (150), is based on the movement of a piezoelectric ceramic transducer, comprised in the print head (150), when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric print head controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial piezoelectric print heads are TOSHIBA TEC™ CK1 and CK1L from TOSHIBA TEC™ (https://www.toshibatec.co.jp/en/products/industrial/inkjet/products/cf1/) and XAAR™ 1002 from XAAR™ (http://www.xaar.com/en/products/xaar-1002).

A liquid channel in a piezoelectric print head is also called a pressure chamber.

Between a liquid channel and a master inlet of the piezoelectric print heads, there is a manifold connected to store the liquid to supply to the set of liquid channels.

The Piezoelectric print head is preferably a through-flow piezoelectric print head. In a preferred embodiment the recirculation of the liquid in a through-flow piezoelectric print head flows between a set of liquid channels and the inlet of the nozzle wherein the set of liquid channels corresponds to the nozzle.

In a preferred embodiment in a Piezoelectric print head the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes.

In a preferred embodiment the Piezoelectric print head has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the Piezoelectric print head has a native print resolution from 25 DPI to 2400 DPI, in a more preferred embodiment the Piezoelectric print head has a native print resolution from 50 DPI to 2400 DPI and in a most preferred embodiment the Piezoelectric print head has a native print resolution from 150 DPI to 3600 DPI.

In a preferred embodiment with the Piezoelectric print head the jetting viscosity is from 8 mPa·s to 200 mPa·s more preferably from 25 mPa·s to 100 mPa·s and most preferably from 30 mPa·s to 70 mPa·s.

In a preferred embodiment with the Piezoelectric print head the jetting temperature is from 10° C. to 100° C. more preferably from 20° C. to 60° C. and most preferably from 30° C. to 50° C.

The nozzle spacing distance of the nozzle row in a piezoelectric print head is preferably from 10 μm to 200 μm; more preferably from 10 μm to 85 μm; and most preferably from 10 μm to 45 μm.

Inkjet Ink

In a preferred embodiment, the liquid in the print head (150) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s-1 or with the HAAKE Rotovisco 1 Rheometer with sensor C60/1 Ti at a shear rate of 1000 s-1

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the print head (150) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

Computer-to-Plate System

The inkjet printing device (10) of the embodiment may be used to create printing plates used for computer-to-plate (CTP) systems in which a proprietary liquid is jetted onto a metal base to create an imaged plate from the digital record. So the inkjet printing method of the embodiment is preferably comprised in an inkjet computer-to-plate manufacturing method. These plates require no processing or post-baking and can be used immediately after the ink-jet imaging is complete. Another advantage is that platesetters with an inkjet printing device (10) is less expensive than laser or thermal equipment normally used in computer-to-plate (CTP) systems. Preferably the object that may be jetted by the embodiment of the inkjet printing device (10) is a lithographic printing plate. An example of such a lithographic printing plate manufactured by an inkjet printing device (10) is disclosed EP1179422 B (AGFA GRAPHICS NV).

The advantage of high productivity to fast load and unload a printing plate from the flatbed table (400) is for a computer-to-plate system an enormous economic advantages due to the capability of high productivity.

Textile Inkjet Printing Device

Preferably the inkjet printing device (10) is a textile inkjet printing device (10), performing a textile inkjet printing method. The handling of such ink-receivers on a flatbed table (400) is difficult due to uncontrolled adhering of the ink-receiver against the flatbed table (400) due to easy crinkle of the ink-receiver while transporting. Due to the present invention, namely the use of the same set of motion rails (450) in the inkjet printing device (10) to load a textile and print a textile it is easier to control any deficiencies on the movement on these used-together motion rails so crinkling of textile can be avoided more easily. The textile is preferably pre-treated by corona treatment by corona discharge equipment because some textiles have chemically inert and nonporous surfaces leading to a low surface energy.

A textile in a textile inkjet printing device (10) is a woven or non-woven textile. A textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles, high density polyethylene textiles and mixtures thereof.

The textile may be transparent, translucent or opaque.

A major advantage of the present invention is that printing can be performed on a wide range of textiles. Suitable textiles can be made from many materials. These materials come from four main sources: animal (e.g. wool, silk), plant (e.g. cotton, flax, jute), mineral (e.g. asbestos, glass fibre), and synthetic (e.g. nylon, polyester, acrylic). Depending on the type of material, it can be knitted, woven or non-woven textile.

The textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles (e.g. Spandex or Lycra™), high density polyethylene textiles (Tyvek™) and mixtures thereof.

Suitable polyester textile includes polyethylene terephthalate textile, cation dyeable polyester textile, acetate textile, diacetate textile, triacetate textile, polylactic acid textile and the like.

Applications of these textiles include automotive textiles, canvas, banners, flags, interior decoration, clothing, swimwear, sportswear, ties, scarves, hats, floor mats, doormats, carpets, mattresses, mattress covers, linings, sacking, upholstery, carpets, curtains, draperies, sheets, pillowcases, flame-retardant and protective fabrics, and the like. In a preferred embodiment the present invention is comprised in the manufacturing of one of these applications. Polyester fibre is used in all types of clothing, either alone or blended with fibres such as cotton. Aramid fibre (e.g. Twaron) is used for flame-retardant clothing, cut-protection, and armour. Acrylic is a fibre used to imitate wools.

Leather Inkjet Printing Device

Preferably the inkjet printing device (10) is a leather inkjet printing device, performing a leather inkjet printing method. The handling of such ink-receivers on a flatbed table (400) is difficult due to uncontrolled adhering of the ink-receiver against the flatbed table (400) due to easy crinkle of the ink-receiver while transporting. Due to the present invention, namely the use of the same set of motion rails (450) in the inkjet printing device (10) to load leather and print a leather it is easier to control any deficiencies on the movement on these used-together motion rails so crinkling of leather can be avoided more easily.

The present invention has also the advantage that no imprinting exists of the dimple pattern in the leather after printing. The leather is preferably pre-treated by corona treatment by corona discharge equipment because some leathers, such as artificial leathers; have chemically inert and nonporous surfaces leading to a low surface energy. Also some leathers also have issues with shrinkage which is avoided by the present invention by a good overall coupling of the leather on the vacuum belt. This is a very high advantage for a Leather inkjet printing device. Artificial leather is a fabric intended to substitute leather in fields such as upholstery, clothing, and fabrics, and other uses where a leather-like finish is required but the actual material is cost-prohibitive, unsuitable, or unusable for ethical reasons.

Artificial leather is marketed under many names, including "leatherette", "faux leather", and "pleather". Suitable artificial leather includes poromeric imitation leather, corfam, koskin and leatherette. Suitable commercial brands include Biothane™ from BioThane Coated Webbing, Birkibuc™ and Birko-Flor™ from Birkenstock, Kydex™ from Kleerdex, Lorica™ from Lorica Sud, and Fabrikoid™ from DuPont.

Applications of these leathers include upholstery, clothing, shoes and the like. In a preferred embodiment the present invention is comprised in the manufacturing of one of these applications.

Corrugated Fibreboard Inkjet Printing Device

Preferably the inkjet printing device (10) is a corrugated fibreboard inkjet printing device, performing a corrugated fibreboard inkjet printing method. The ink-receiver of such inkjet printing device (10) is always corrugated fibreboard. Corrugated fibreboard is a paper-based material consisting of a fluted corrugated medium and one or two flat linerboards. The corrugated medium and linerboard board are preferably made of kraft containerboard and/or preferably corrugated fibreboard is between 3 mm and 15 mm thick. Corrugated fibreboard is sometimes called corrugated cardboard; although cardboard might be any heavy paper-pulp based board. The fast production by the present invention for printed corrugated fibreboard is a economically advantage.

Other Embodiment 1

The present invention is also an inkjet printing device (10) comprising:

a fast-scan drive module, attached to a first gantry (100), for moving back-and-forth, parallel to a first direction above a flatbed table (400), a print head (150), comprising a nozzle row; and wherein the first direction is perpendicular to the nozzle row; and a slow-scan drive module, attached to the Inkjet printing device (10), for moving back-and-forth (120) above the flatbed table (400), parallel to a second direction, the first gantry (100) on a set of motion rails (450), attached to the Inkjet printing device (10); and wherein the second direction is perpendicular to the first direction; and an output drive module, attached to an output gantry (300) for unloading a print-finished ink-receiver from the flatbed table (400) by coupling the print-finished ink-receiver to the output gantry (300); and moving parallel to the second direction the output gantry (300) on the set of motion rails (450) while the print-finished ink-receiver is coupled to the output gantry (300).

The preferred embodiments as detailed in the description of embodiments above apply also on this embodiment together with the provided problem-solution reasoning.

Other Embodiment 2

The present invention is also an inkjet printing device (50) wherein the print head is not scanning along the fast-scan direction but an array of print heads, preferably staggered, along the print gantry, are attached. This page-wide print-head array comprises nozzle-rows, perpendicular to the slow-scan direction and print direction. To print an ink layer on loaded ink-receivers the print gantry (100) moves parallel the print direction, in one direction or bi-directional, while printing.

So this embodiment is an inkjet printing device (10) comprising:

a first gantry (100) comprising a page-wide print-head array, wherein the page-wide print-head array comprises a nozzle row; and a fast-scan drive module, attached to the Inkjet printing device (10), for moving back-and-forth above the flatbed table (400) the first gantry (100) on a set of motion rails (450), attached to the Inkjet printing device (10), in a fast-scan direction wherein the fast-scan direction is perpendicular to the nozzle row; and a first drive module, attached to a second gantry (200), for:

moving parallel to the fast-scan direction the second gantry (200) on the set of motion rails (450) while an ink-receiver (20) is coupled to the second gantry (200); and loading the ink-receiver (20) on the flatbed table (400) by decoupling the ink-receiver (20) from the second gantry (200).

The fast-scan direction is in this embodiment also parallel to the input-to-output direction also called the print-direction.

The preferred embodiments as detailed in the description of embodiments above apply also on this embodiment together with the provided problem-solution reasoning.

REFERENCE SIGNS LIST

TABLE 1

| | | | |
|---|---|---|---|
| 10 | inkjet printing device | 300 | output gantry |
| 100 | print gantry | 350 | ink-receiver coupler |
| 150 | print head | 400 | flatbed table |
| 200 | Input gantry | 450 | motion rail |
| 250 | ink-receiver coupler | 20 | ink-receiver |
| 220 | input gantry movement | 25 | jetted layer |
| 120 | print gantry movement | 320 | output gantry movement |
| 500 | input tray | 600 | output tray |

The invention claimed is:

1. An inkjet printing device comprising:

a flatbed table;

a first gantry mounted on a set of motion rails attached to the inkjet printing device, the first gantry including a print head that moves back-and-forth in a first direction above the flatbed table, the print head including a row of nozzles extending in a direction perpendicular to the first direction, and the first gantry moves along the set of motion rails in a second direction perpendicular to the first direction; and a second gantry that moves parallel to the second direction along the set of motion rails while an ink-receiver is coupled to the second gantry, and the second gantry loads the ink-receiver on the flatbed table by coupling and decoupling the ink-receiver from the second gantry; wherein the set of motion rails on which the first gantry moves and the set of motion rails on which the second gantry moves are the same set of motion rails.

2. The inkjet printing device according to claim 1, further comprising:

a third gantry that unloads a print-finished ink-receiver from the flatbed table by coupling and decoupling the print-finished ink-receiver to the third gantry; wherein the third gantry moves parallel to the second direction along the set of motion rails while the print-finished ink-receiver is coupled to the third gantry.

3. The inkjet printing device according to claim 1, further comprising:

a third gantry that unloads a print-finished ink-receiver from the flatbed table by coupling and decoupling the print-finished ink-receiver to the third gantry; wherein the third gantry moves parallel to the second direction on a second set of motion rails attached to the inkjet printing device while the print-finished ink-receiver is coupled to the third gantry.

4. The inkjet printing device according to claim 2, wherein the second gantry is provided in an auto-loader that automatically loads the ink-receiver by checking for free space on the flatbed table that is reachable by the second gantry based on:

determination of a loading time derived from a dimension of the ink-receiver;

determination of a position of the ink-receiver from the first gantry during the loading time; and determination of a reachable free space on the flatbed table during the loading time; and/or the auto-loader automatically unloads the print-finished ink-receiver by checking loaded space on the flatbed table reachable by the third gantry based on:

determination of an unloading time derived from a dimension of the print-finished ink-receiver on the flatbed table;

determination of a position of the print-finished ink-receiver from the first gantry during the unloading time; and determination of a reachable loaded space during the unloading time.

5. The inkjet printing device according to claim 1, wherein the second gantry unloads a print-finished ink-receiver from the flatbed table by coupling the print-finished ink-receiver to the second gantry.

6. The inkjet printing device according to claim 5, wherein the second gantry is provided in an auto-loader that automatically loads the ink-receiver by checking free space on the flatbed table reachable by the second gantry based on:

a determination of a loading time derived from a dimension of the ink-receiver;

a determination of a position of the ink-receiver from the first gantry during the loading time; and a determination of the reachable free space on the flatbed table during the loading time; and the auto-loader automatically unloads the print-finished ink-receiver by checking loaded space on the flatbed table reachable by the second gantry based on:

a determination of an unloading time derived from a dimension of the print-finished ink-receiver on the flatbed table;

a determination of a position of the print-finished ink-receiver from the first gantry during the unloading time; and a determination of a reachable loaded space during the unloading time.

7. An inkjet printing method comprising the steps of:

moving a print head including a nozzle row and attached to a first gantry back-and-forth and parallel to a first direction above a flatbed table, the first direction being perpendicular to the nozzle row;

moving the first gantry, which is attached to an inkjet printing device, back-and-forth on a set of motion rails parallel to a second direction above the flatbed table, the second direction being perpendicular to the first direction;

coupling an ink-receiver to a second gantry;

moving the second gantry parallel to the second direction on the set of motion rails while the ink-receiver is coupled to the second gantry; and loading the ink-receiver on the flatbed table by decoupling the ink-receiver from the second gantry; wherein the set of motion rails on which the first gantry moves and the set of motion rails on which the second gantry moves are the same set of motion rails.

8. The inkjet printing method according claim 7, further comprising the steps of:

unloading a print-finished ink-receiver from the flatbed table by coupling the print-finished ink-receiver to a third gantry;

moving the third gantry parallel to the second direction on the set of motion rails, or on another set of motion rails, while the ink-receiver is coupled to the third gantry; and decoupling the print-finished ink-receiver from the third gantry.

9. The inkjet printing method according to claim 8, further comprising the steps of:

automatically loading the ink-receiver by checking for free space on the flatbed table reachable by the second gantry by performing the steps of:

determining a loading time derived from a dimension of the ink-receiver;

determining a position of the ink-receiver from the first gantry during the loading time; and determining a reachable free space on the flatbed table during the loading time; and automatically unloading the print-finished ink-receiver by checking a loaded space on the flatbed table reachable by the third gantry by performing the steps of:

determining an unloading time derived from a dimension of the print-finished ink-receiver;

determining a position of the print-finished ink-receiver from the first gantry during the unloading time; and determining a reachable loaded space during the unloading time.

10. The inkjet printing method according to claim 7, wherein the step of coupling the ink-receiver to the second gantry includes the steps of:

clamping the ink-receiver with a clamp; and/or sucking the ink-receiver with a suction cup.

11. The inkjet printing method according to claim 7, wherein the ink-receiver is magnetizable and the step of coupling of the ink-receiver to the second gantry includes the step of:

magnetizing the ink-receiver by switching on an electromagnet.

12. The inkjet printing method according to claim 7, further comprising the steps of:

unloading a print-finished ink-receiver from the flatbed table by coupling the print-finished ink-receiver to the second gantry;

moving the second gantry parallel to the second direction on the set of motion rails while the print-finished ink-receiver is coupled to the second gantry; and decoupling the print-finished ink-receiver from the second gantry to a first tray.

13. The inkjet printing method according to claim 9, wherein the step of determining the reachable free space on the flatbed table during the loading time includes the step of:

imaging loaded ink-receivers on the flatbed table with an imaging device to determine positions of the loaded ink-receivers.

14. The inkjet printing method according to claim 7, further comprising the step of:

moving a drying gantry back-and-forth parallel to the second direction on the set of motion rails to move a drying source, which is attached to another gantry.

15. The inkjet printing method according to claim 14, further comprising the step:

moving the drying source back-and-forth and parallel to the first direction above the flatbed table.

* * * * *